US009599964B2

(12) United States Patent
Gracia et al.

(10) Patent No.: US 9,599,964 B2
(45) Date of Patent: Mar. 21, 2017

(54) EXTERIOR ELEMENT FOR A WRISTWATCH MIDDLE PART

(71) Applicant: The Swatch Group Management Services AG, Biel (CH)

(72) Inventors: Jean-Claude Gracia, Morigen (CH); Christophe Barbier, Lignieres (CH); Silvano Bonadei, Delemont (CH); Raphael Waecker, Sonvilier (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 14/478,198

(22) Filed: Sep. 5, 2014

(65) Prior Publication Data

US 2015/0124574 A1 May 7, 2015

(30) Foreign Application Priority Data

Nov. 6, 2013 (CH) ..... 1860/13

(51) Int. Cl.
*G04B 37/00* (2006.01)
*G04B 37/14* (2006.01)
*G04B 45/00* (2006.01)

(52) U.S. Cl.
CPC ..... *G04B 37/0008* (2013.01); *G04B 45/0076* (2013.01); *G04B 37/1486* (2013.01)

(58) Field of Classification Search
CPC G04B 37/005; G04B 37/087; G04B 37/1486; G04B 37/0008; G04B 45/0076; A44C 5/00; A44C 5/14; A44C 5/147
USPC ..... 368/281, 282, 283, 285, 286, 294, 295; 224/164, 167, 168, 170, 171
See application file for complete search history.

(56) References Cited

U.S. PATENT DOCUMENTS 1,704,859 A * 3/1929 Kraemer ..... G04B 37/1486 24/265 WS
2,446,065 A * 7/1948 Starke ..... G04B 37/1486 24/265 B
2,948,941 A * 8/1960 Bruhn ..... A44C 5/14 24/265 B
3,039,263 A * 6/1962 Wyler ..... G04B 37/1493 24/265 B
3,242,664 A * 3/1966 Lederrey ..... 368/281
3,968,643 A * 7/1976 Curtil ..... 368/280
4,034,552 A * 7/1977 Davidson ..... 368/280
4,167,850 A * 9/1979 Schneider ..... 368/282
4,396,298 A * 8/1983 Ripley ..... 368/300
4,417,821 A * 11/1983 Herchenbach ..... 368/291
4,674,892 A * 6/1987 Loth ..... G04B 39/02 368/280
4,722,179 A * 2/1988 Tesch ..... 59/82
4,740,935 A * 4/1988 Gogniat ..... 368/294
4,742,503 A * 5/1988 Braun et al. ..... 368/282
4,903,253 A * 2/1990 Nikles et al. ..... 368/282
4,958,334 A * 9/1990 Grosjean ..... G04B 37/1486 368/282
5,206,841 A * 4/1993 Boucheron ..... 368/276
(Continued)

*Primary Examiner* — Vit W Miska
(74) *Attorney, Agent, or Firm* — Oblon, McClelland, Maier & Neustadt, L.L.P.

(57) ABSTRACT

Exterior element for a wristwatch middle part, wherein said exterior element takes the form of a separate cover plate which is fixed to the wristwatch middle part and at least partially covers a connection area between a bracelet strand and the watch middle part.

2 Claims, 4 Drawing Sheets

(56) References Cited

U.S. PATENT DOCUMENTS

| | | | | | |
|---|---|---|---|---|---|
| 5,319,616 | A * | 6/1994 | Jolidon | 368/282 | |
| 5,341,552 | A * | 8/1994 | Voumard | 29/896.33 | |
| 5,557,587 | A * | 9/1996 | Tosaka et al. | 368/282 | |
| 5,657,515 | A * | 8/1997 | Bert | A44C 5/14 | 24/265 B |
| 5,668,784 | A * | 9/1997 | Iguchi | 368/282 | |
| 5,831,939 | A * | 11/1998 | Kaelin | 368/276 | |
| 7,293,332 | B2 * | 11/2007 | Maillard | A44C 5/14 | 24/265 B |
| 7,708,457 | B2 * | 5/2010 | Girardin et al. | 368/287 | |
| 2005/0235464 | A1 * | 10/2005 | Sima | A44C 5/14 | 24/265 WS |
| 2008/0049560 | A1 * | 2/2008 | Clarkson et al. | 368/281 | |
| 2008/0106980 | A1 * | 5/2008 | Guillaume | 368/282 | |
| 2010/0238770 | A1 * | 9/2010 | Speichinger | 368/282 | |
| 2011/0113599 | A1 * | 5/2011 | Ehrsam et al. | 24/573.11 | |
| 2013/0021881 | A1 * | 1/2013 | Bertucci | 368/282 | |
| 2013/0272103 | A1 * | 10/2013 | Mong | 368/282 | |
| 2014/0098649 | A1 * | 4/2014 | Tschumi | G04B 37/1486 | 368/282 |

* cited by examiner

EXTERIOR ELEMENT FOR A WRISTWATCH MIDDLE PART

This application claims priority from Swiss Patent Application No. 01860/13 filed 6 Nov. 2013, the entire disclosure of which is incorporated herein by reference.

FIELD OF THE INVENTION

The present invention concerns an exterior element for a wristwatch middle part. More specifically, the present invention concerns an exterior element intended to protect and to improve the aesthetics of the connection area between the bracelet strands and the watch middle part.

BACKGROUND OF THE INVENTION

An example embodiment of a wristwatch middle part according to the prior art is shown in FIG. 1 annexed to the present Patent Application. Designated as a whole by the general reference numeral 1, the watch middle part is delimited below by a back cover 2, and above by a bezel 4. Middle part 1 also includes, at 6 o'clock, a plurality of horns 6, four in number in the illustrated example, for the fixing of a first bracelet strand (not illustrated). Of course, middle part 1 includes, at 12 o'clock, the same number of horns (not visible in the drawing) for the fixing of a second bracelet strand 8.

As shown clearly in FIG. 1, middle part 1 includes a cover surface 10 which partially covers a connection area 12 between the bracelet strands and middle part 1. This cover surface 10 has the function of protecting connection area 12 against the intrusion of particles which, depending on their size and hardness, may damage the flexible material, for example rubber, of which the bracelet is made and cause deterioration of the bracelet. Cover surface 10 also has the function of improving the aesthetics of the watch by partially concealing the connection area 12 between middle part 1 and the bracelet strands.

It is understood that, in the example of FIG. 1, cover surface 10 is integral with middle part 1. However, cover surface 10 considerably complicates the geometry of middle part 1. Consequently, depending on the material of which middle part 1 is made, machining operations are rendered more complex and therefore more expensive. By way of example, if middle part 1 is obtained by plastic moulding, the presence of cover surface 10 requires complex and therefore expensive injection moulds. Likewise, if middle part 1 is made of steel, the obtention of cover surface 10 requires long, tedious machining operations which slow down production rates.

It is an object of the present invention to overcome the aforementioned drawbacks in addition to others by providing an exterior element for a wristwatch middle part which makes it possible, with no difficulty, to conceal the connection area between a bracelet strand and a watch middle part and to improve the aesthetics of the watch.

SUMMARY OF THE INVENTION

To this end, the present invention concerns an exterior element for a wristwatch middle part, characterized in that the exterior element takes the form of a separate cover plate which is fixed to the wristwatch middle part and at least partially covers a connection area between a bracelet link and the watch middle part.

According to a complementary feature of the invention, the cover plate is made in one piece with a bezel fixed to the watch middle part.

According to yet another feature of the invention, the cover plate or the bezel which is made in one piece with the cover plate, is secured or driven onto the watch middle part.

As a result of these features, the present invention provides an exterior element for a wristwatch middle part which takes the form of a separate component which is affixed by any suitable means to a watch middle part and which at least partially covers the connection area between a bracelet strand and the watch middle part. Indeed, it was discovered that manufacturing the cover plate and the middle part separately is much simpler and more economical than when the cover surface is integral with the watch middle part. In fact, when the middle part is devoid of a cover surface for the connection area, its shapes are less complex, so that production thereof, for example by moulding or machining in the mass, is faster, which makes it possible to increase production rates. This also applies to the cover plate, which can be obtained by plastic injection moulding or may be cut into a profile. Further, the fact that the cover plate is made separately from the middle part offers designers great freedom as to the choice of the final shape or colour of the cover plate. According to a variant embodiment, the cover plate is made in one piece with a bezel which is affixed by any suitable means such as adhesive bonding or driving onto the watch middle part. In this case too, because of the relatively simple geometric shapes, the bezel and the cover plate can accommodate any suitable decoration, for example by printing.

BRIEF DESCRIPTION OF THE DRAWINGS

Other features and advantages of the present invention will appear more clearly from the following detailed description of an example embodiment of the exterior element for a wristwatch according to the invention, this example being given solely by way of non-limiting illustration with reference to the annexed drawing, in which.

DETAILED DESCRIPTION OF THE INVENTION

The present invention proceeds from the general inventive idea which consists in separately producing a wristwatch middle part and a cover plate intended to at least partly conceal a connection area between a bracelet strand and the middle part. In the prior art, the cover plate was made in one piece with the middle part, which made the geometry of the middle part complex and the production thereof long and expensive. According to the invention, the middle part and the cover plate are distinct from each other, so that these components have simpler shapes and are therefore easier to produce. Further, because the cover plate is separate from the middle part, this allows designers great freedom as to the choice of the shape and colour of the cover plate. The cover plate is fixed or secured to the middle part by any suitable means.

Figure 1:
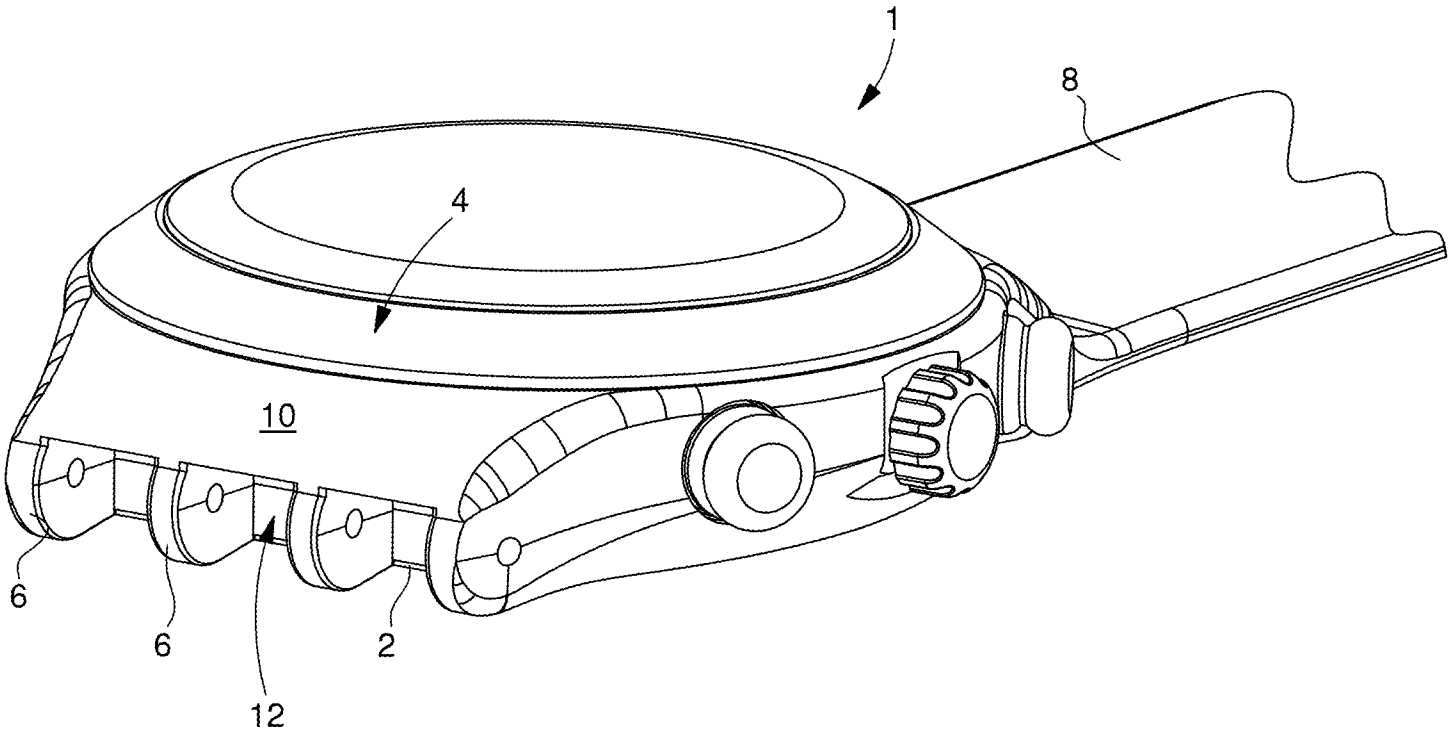
FIG. 1, already cited, is a perspective view of a watch middle part according to the prior art.
Figure 2:
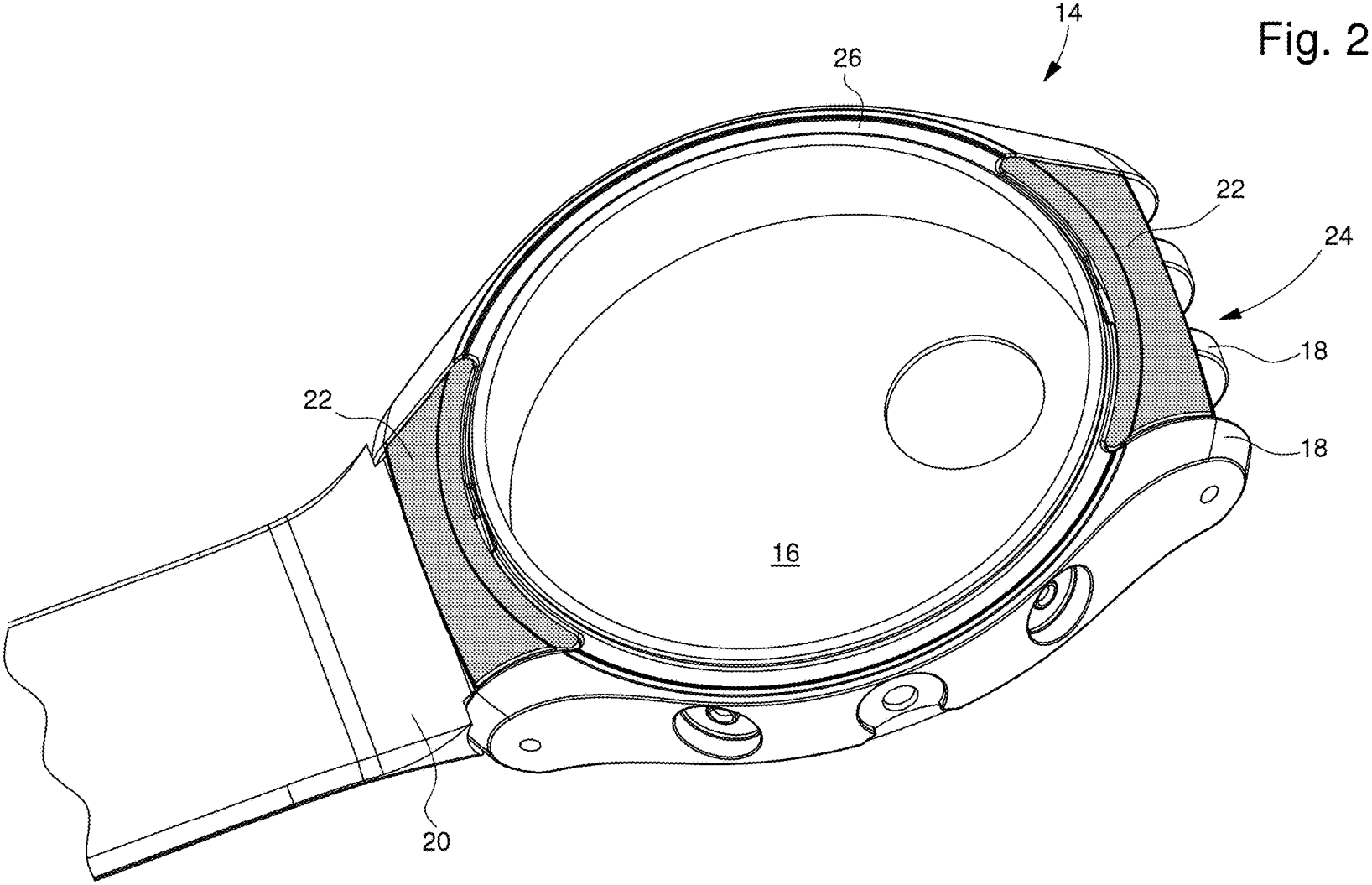
FIG. 2 is a perspective view of a watch middle part equipped with a cover plate according to the invention.

FIG. 2 is a perspective view of a watch middle part equipped with a cover plate according to the invention. Designated as a whole by the general reference numeral 14, the watch middle part is delimited below by a back cover 16. Middle part 14 also includes, at 12 o'clock, a plurality of horns 18, four in number in the illustrated example, for the fixing of a first bracelet strand (not illustrated). Of course, middle part 14 includes, at 6 o'clock, the same number of horns (not visible in the drawing) for the fixing of a second bracelet strand 20.

As clearly shown in FIG. 2, middle part 14 includes a cover plate 22 which partially covers a connection area 24 between the bracelet strands and middle part 14. This cover plate 22 is a separate element from middle part 14 which is affixed to middle part 14 by any suitable means such as driving on or adhesive bonding. Cover plate 22 has the function of protecting connection area 24 against the intrusion of particles which, depending on their size and hardness, may damage the flexible material, for example plastic or rubber, of which the bracelet is made, and cause deterioration of the bracelet. This is also the case of a bracelet made, for example, of aluminium wherein the pivoting movements of the links may be hampered by such particles. Cover plate 22 also has the function of improving the aesthetics of the watch by partially concealing the connection area 24 between middle part 14 and the bracelet strands. Further, because cover plate 22 is a separate element, designers enjoy great freedom as to the choice of the final shape and colour thereof.

According to a first variant embodiment, there are added to middle part 14, on the one hand, two cover plates 22 at 12 o'clock and 6 o'clock respectively, and, on the other hand, a bezel 26.

Figure 3:
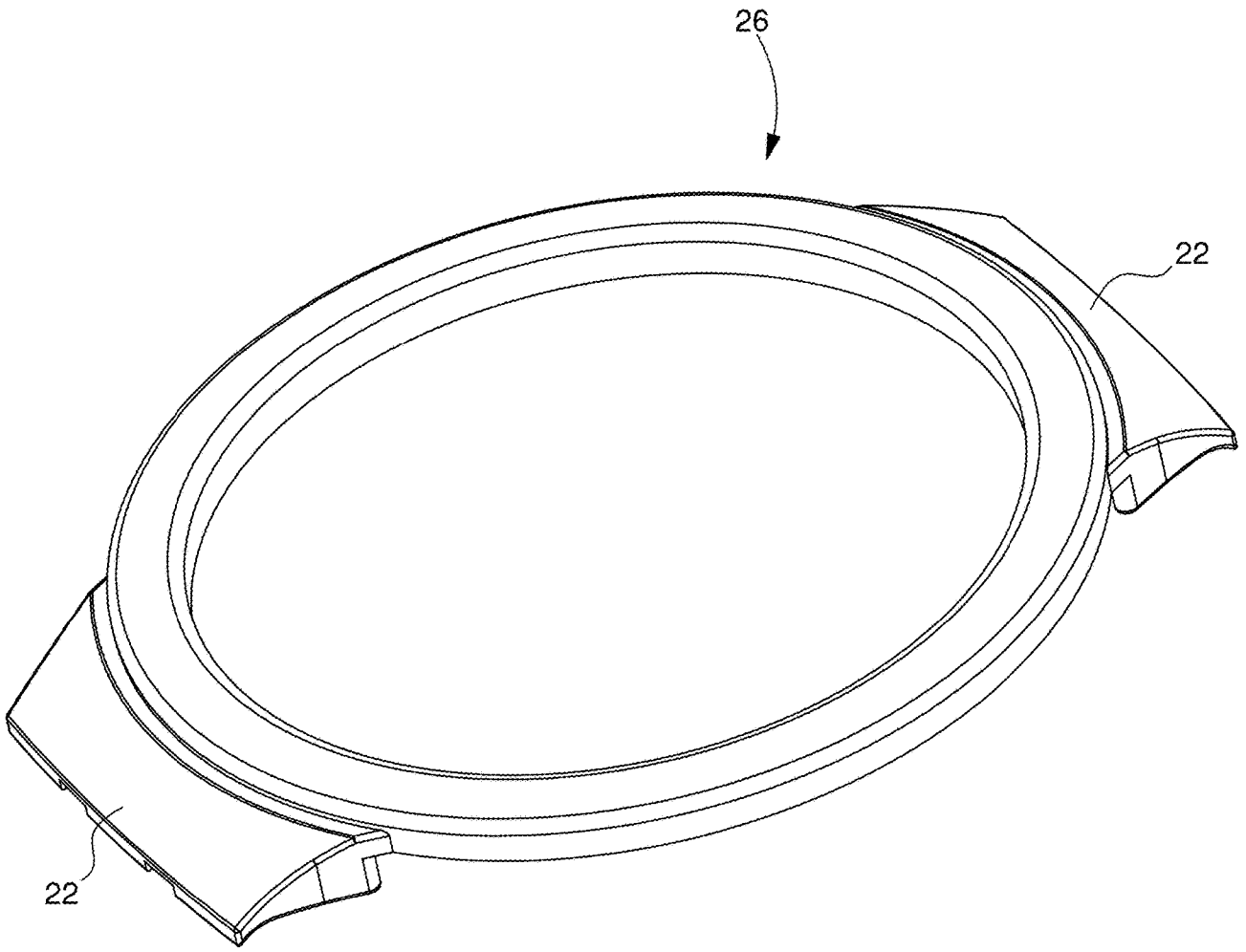
FIG. 3 is a perspective view of a cover plate according to the invention made in one piece with a bezel.

According to a second variant embodiment illustrated in FIG. 3, cover plates 22 are made in one piece with bezel 26 which is fixed to watch middle part 14.

Figure 4:
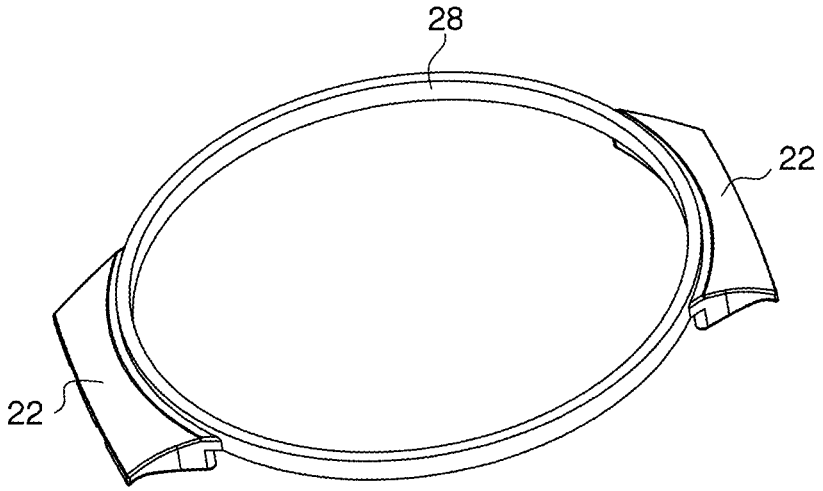
FIG. 4 illustrates a third variant embodiment of the invention wherein the cover plates are made in one piece with a ring.
Figure 5:
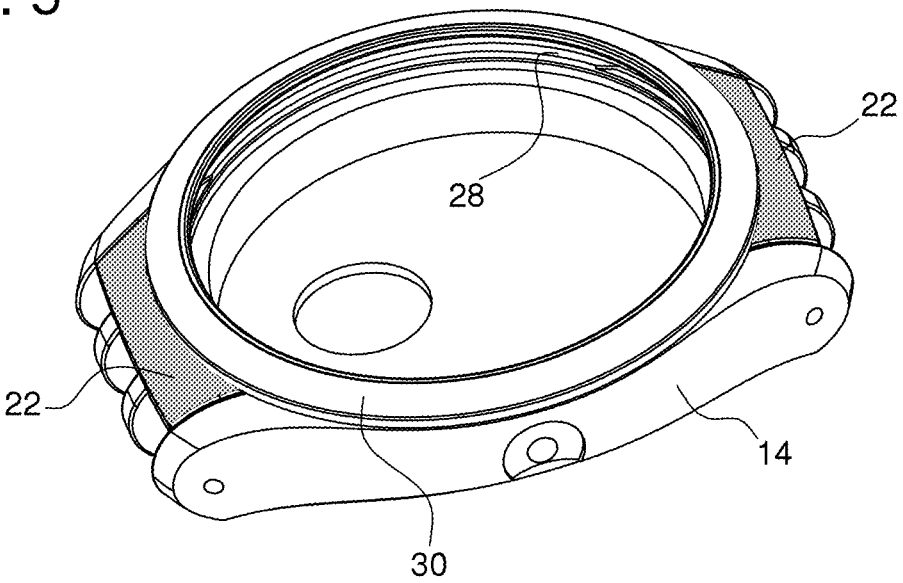
FIG. 5 is a perspective view of the assembly of FIG. 4 fixed to the middle part of the watch case and covered by a bezel.

According to a third variant embodiment of the invention illustrated in FIGS. 4 and 5, cover plates 22 are made in one piece with a ring 28. The assembly thereby obtained is fixed to watch middle part 14 by any suitable means, such as driving in or adhesive bonding, and then covered by a bezel 30.

It goes without saying that this invention is not limited to the embodiment that has just been described and that various simple modifications and variants can be envisaged by those skilled in the art without departing from the scope of the invention as defined by the annexed claims. In particular, it will be understood that, although the present invention was described with reference to a unique cover plate, it goes without saying that the middle part normally includes two cover plates of this type.

What is claimed is:

1. An exterior element for a wristwatch middle part, wherein the exterior element comprises a cover plate, wherein the cover plate is affixed as a separate piece to the wristwatch middle part, wherein the watch middle part comprises two outer horns that define a connection area to fix the bracelet strand between the outer horns, and wherein the cover plate substantially conceals an area between the two outer horns while keeping the two outer horns visible, wherein the cover plate and an annular part surrounding a crystal of the wristwatch form a single piece that is mounted as one to the wristwatch, and wherein the annular part is a bezel.

2. The exterior element according to claim 1, wherein the cover plate is shaped to extend around the bezel.

* * * * *